US005555935A

United States Patent [19]

Brammer et al.

[11] Patent Number: 5,555,935

[45] Date of Patent: Sep. 17, 1996

[54] FLUID CONNECTOR FOR WELL

[75] Inventors: Norman Brammer, Aberdeen, Scotland; Brett R. McConaughy, Jurong, Singapore; James A. Gariery, Houston, Tex.

[73] Assignee: ABB Vetco Gray Inc., Houston, Tex.

[21] Appl. No.: 470,104

[22] Filed: Jun. 6, 1995

Related U.S. Application Data

[63] Continuation-in-part of Ser. No. 294,679, Aug. 23, 1994, Pat. No. 5,465,794.

[51] Int. Cl.[6] ..... E21B 34/10

[52] U.S. Cl. ..... 166/88.1; 166/88.4; 166/368; 166/375; 166/382; 285/133.2; 285/137.2

[58] Field of Search ..... 166/88.1, 88.4, 166/341, 344, 368, 373–375, 382; 285/133.2, 137.2

[56] References Cited

U.S. PATENT DOCUMENTS

| | | | |
|---|---|---|---|
| 3,965,977 | 6/1976 | Beson | 166/88.4 |
| 4,181,175 | 1/1980 | McGee et al. | 166/88.4 |
| 4,219,223 | 8/1980 | Schulte | 285/26 |
| 4,333,526 | 6/1982 | Watkins | 166/87 |
| 4,434,853 | 3/1984 | Bourgeois | 166/88.4 X |
| 4,449,583 | 5/1984 | Lawson | 166/72 |
| 4,458,903 | 7/1984 | Tohill | 166/75.1 X |
| 4,491,176 | 1/1985 | Reed | 166/88.4 X |
| 4,607,691 | 8/1986 | Bridges | 285/137.2 |
| 4,616,857 | 10/1986 | Woodman et al. | 285/140 |
| 4,623,020 | 11/1986 | Nichols | 166/88 |
| 4,796,922 | 1/1989 | Prichard | 285/26 |
| 5,366,017 | 11/1994 | Voss | 166/88.4 X |
| 5,372,199 | 12/1994 | Cegielski et al. | 166/368 |
| 5,465,794 | 11/1995 | McConaughy et al. | 166/375 |

FOREIGN PATENT DOCUMENTS

| | | |
|---|---|---|
| 2030620 | 4/1980 | United Kingdom . |
| 2161188 | 7/1984 | United Kingdom . |

*Primary Examiner*—Roger J. Schoeppel

[57] ABSTRACT

An annular wellhead member has an inner mating surface. The wellhead member has a auxiliary fluid passage with an inboard opening at the inner mating surface. A tubing hanger is landed concentrically within the wellhead member. The tubing hanger has an outer mating surface which mates with the inner mating surface of the wellhead member. A production fluid passage through the tubing hanger places the production tubing string in communication with a production line. A hydraulic line extends from a hydraulically operated downhole safety valve to the tubing hanger. A tubing hanger auxiliary fluid passage has a first opening and an outboard opening. The first opening is connected to the hydraulic line. The outboard opening is located on the outer mating surface of the tubing hanger and registers with the inboard opening of the wellhead member auxiliary fluid passage. The wellhead member auxiliary fluid passage is connected to a hydraulic supply line. An alignment device aligns the outboard opening of the tubing hanger auxiliary fluid passage and the inboard opening of the wellhead member auxiliary fluid passage. A seal ring is concentrically located around the openings. Auxiliary fluid is supplied from the exterior of the wellhead member to the downhole safety valve.

19 Claims, 4 Drawing Sheets

FLUID CONNECTOR FOR WELL

CROSS-REFERENCE TO RELATED APPLICATION

This application is a continuation-in-part of application Ser. No. 08/294,679 filed Aug. 23, 1994 now U.S. Pat. No. 5,465,794.

BACKGROUND OF THE INVENTION

1. Field of the Invention

This invention relates in general to well production systems, and in particular to a hydraulic seal between a tubing hanger and a wellhead member for providing hydraulic fluid to a hydraulically operated downhole safety valve.

2. Description of the Prior Art

Downhole safety valves are often used in well production systems. These downhole safety valves are connected into the production tubing string and are designed to shut off flow through the production tubing string in case of a malfunction so as to avoid a blowout.

Most downhole safety valves are hydraulically operated. Hydraulic pressure maintains the valve in the open position. Removal or interruption of the hydraulic pressure causes the safety valve to shut off flow through the production tubing string. In case of an emergency, the hydraulic pressure can be either intentionally interrupted, or might be interrupted by the catastrophe itself, thus avoiding a blowout.

A hydraulic line usually extends to the downhole safety valve from the surface to provide the safety valve with hydraulic fluid pressure. The hydraulic fluid line usually extends adjacent the production tubing string. The connection at the surface between the hydraulic fluid line and the hydraulic fluid source is often a concern because the hydraulic line usually reaches the surface on the inside of the wellhead members and must make a connection with the exterior of the wellhead members.

One common technique for providing hydraulic fluid from outside the wellhead to the hydraulic fluid line extending to the downhole safety valve is to connect the top of the hydraulic fluid line to a tubing hanger hydraulic fluid passage in the tubing hanger. The tubing hanger hydraulic fluid passage has a lateral portion which communicates with a wellhead member hydraulic fluid passage extending laterally through the wellhead member within which the tubing hanger is landed. The wellhead member hydraulic fluid passage is in turn connected to the hydraulic fluid source.

The sealing connection between the tubing hanger hydraulic fluid passage and the wellhead member hydraulic fluid passage is accomplished by the use of two circumferential annular seals. One seal extends around the circumference of the tubing hanger just above the lateral openings of the hydraulic fluid passages in the tubing hanger and wellhead member. Another seal extends around the circumference of the tubing hanger just below the lateral openings of the hydraulic fluid passages of the tubing hanger and wellhead member. Each of these two seals forms an annular seal between the circumference of the tubing hanger and the wellhead member so as to isolate an annular void between the tubing hanger and the wellhead member through which the hydraulic fluid passages can communicate.

Where the application allows, another common technique for providing hydraulic fluid from outside the wellhead to the hydraulic fluid line extending to the downhole safety valve is to obviate the need for the annular seals by providing a screwed connection directly to the tubing hanger hydraulic fluid passage. The hydraulic fluid source line is screwed through the wellhead and into a radial threaded opening of the tubing hanger hydraulic fluid passage.

Another common technique for providing hydraulic fluid from outside the wellhead to the hydraulic fluid line extending to the downhole safety valve is to have a vertical tubing hanger hydraulic fluid passage which extends the full length of the tubing hanger. The hydraulic line from the downhole safety valve connects into the bottom opening of the tubing hanger hydraulic passage. A stab from the top of the wellhead connects to the upper opening of the tubing hanger hydraulic fluid passage, thus providing hydraulic fluid to the downhole safety valve.

The annular circumferential seal method described above is the preferred method from an installation perspective because once the tubing hanger is landed into the wellhead, the hydraulic connection is complete. However, due to the large diameters involved, and the harsh conditions encountered during installation and operation, it is difficult to create reliable circumferential annular seals between the tubing hanger and wellhead member, especially for high pressure applications. Also, since the tubing hanger is often landed into the wellhead member under imperfect conditions, preventing seal damage during, and prior to, installation is also a concern.

The stab methods, both radial and vertical, described above are more suited for high pressure applications, however, installation is more complex and the stab line extending through the wellhead creates additional concerns.

A need exists for a reliable, high pressure, easy to install connection for providing hydraulic fluid from outside the wellhead to the hydraulically operated downhole safety valve.

SUMMARY OF THE INVENTION

It is the general object of the invention to provide a reliable, high pressure, easy to install connection between the hydraulic line extending from the hydraulically operated downhole safety valve of a well production system to the hydraulic fluid source at the surface.

A wellbore extends from the earth's surface downward to a fluid bearing formation located below the earth's surface. At least one casing string is suspended within the wellbore. A production tubing string extends concentrically within the casing string. The production tubing string conveys production fluids from the fluid bearing formation to the earth's surface.

An annular wellhead member is located at an upper end of the wellbore and has an inner mating surface. The wellhead member also has a hydraulic fluid passage extending laterally therethrough and having an inboard opening at the inner mating surface. A tubing hanger is connected to the upper extremity of the production tubing string and is landed concentrically within the wellhead member for suspending the production tubing string within the wellbore.

The tubing hanger has an outer mating surface which mates with the inner mating surface of the wellhead member. A production fluid passage extends through the tubing hanger for placing the production tubing string in communication with a production line.

A hydraulically actuated downhole safety valve is connected into the production tubing string for selectively interrupting fluid flow through the production tubing string.

A hydraulic line extends upward from the downhole safety valve to the tubing hanger. A tubing hanger hydraulic fluid passage extends through the tubing hanger and has a first opening and an outboard opening. The first opening is connected to the hydraulic line and is in communication with the downhole safety valve. The outboard opening is located on the outer mating surface of the tubing hanger and registers with the inboard opening of the wellhead member hydraulic fluid passage. The wellhead member hydraulic fluid passage is connected to a hydraulic supply line.

A rotational alignment means aligns the outboard opening of the tubing hanger hydraulic fluid passage and the inboard opening of the wellhead member hydraulic fluid passage. A seal recess is formed in a selected one of the mating surfaces. The recess has an axis concentric with an axis of the opening and surrounds the opening in said selected one of the mating surfaces. A seal ring is concentrically located in the seal recess for providing a sealing connection between the tubing hanger hydraulic fluid passage and the wellhead member hydraulic fluid passage, wherein hydraulic fluid is supplied from the exterior of the wellhead member to the downhole safety valve.

The above as well as additional objects, features, and advantages will become apparent in the following description.

DETAILED DESCRIPTION OF THE INVENTION

Figure 1A:
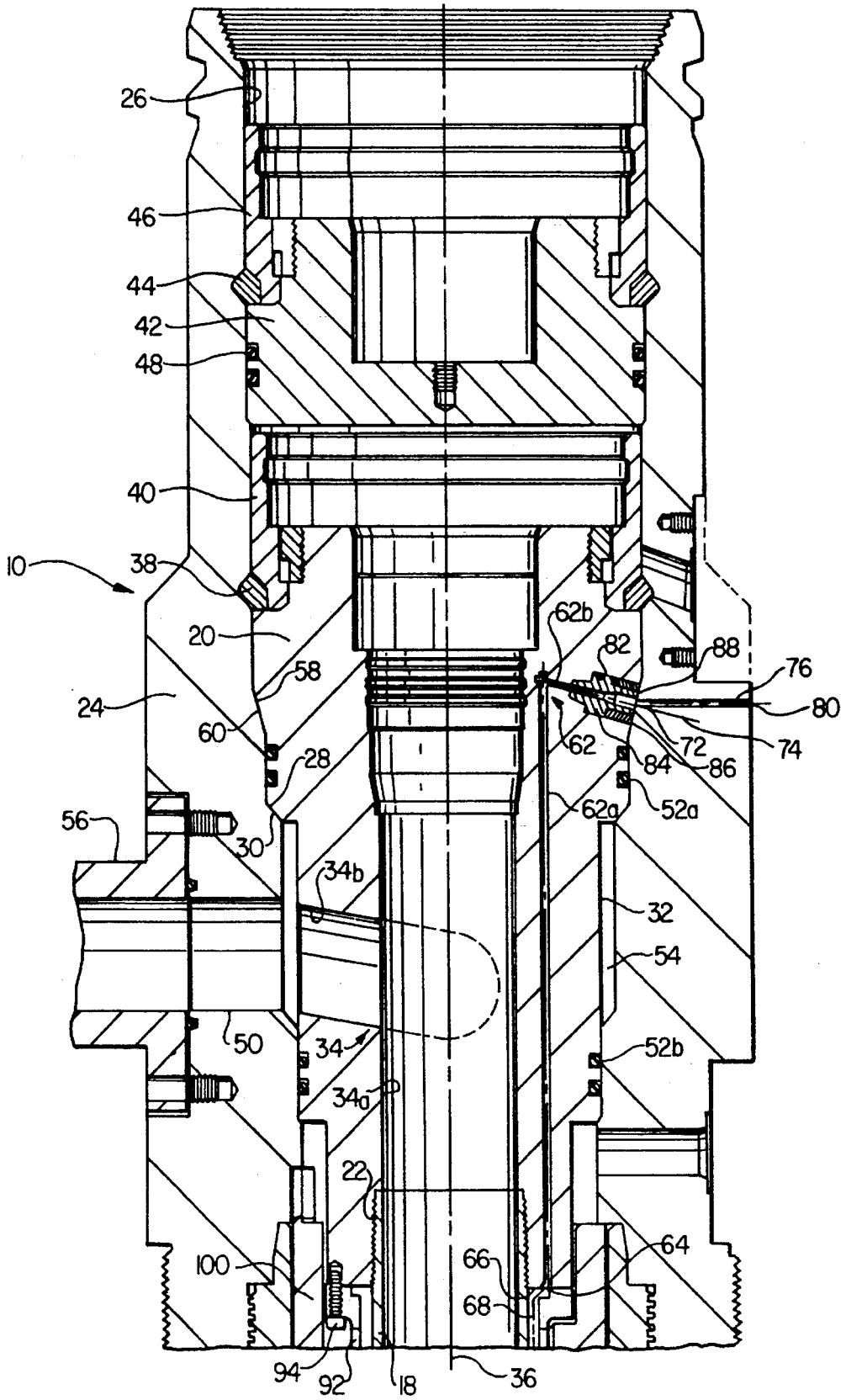
FIG. 1A is a vertical cross sectional view of an upper portion of the well production assembly of the present invention.
Figure 1B:
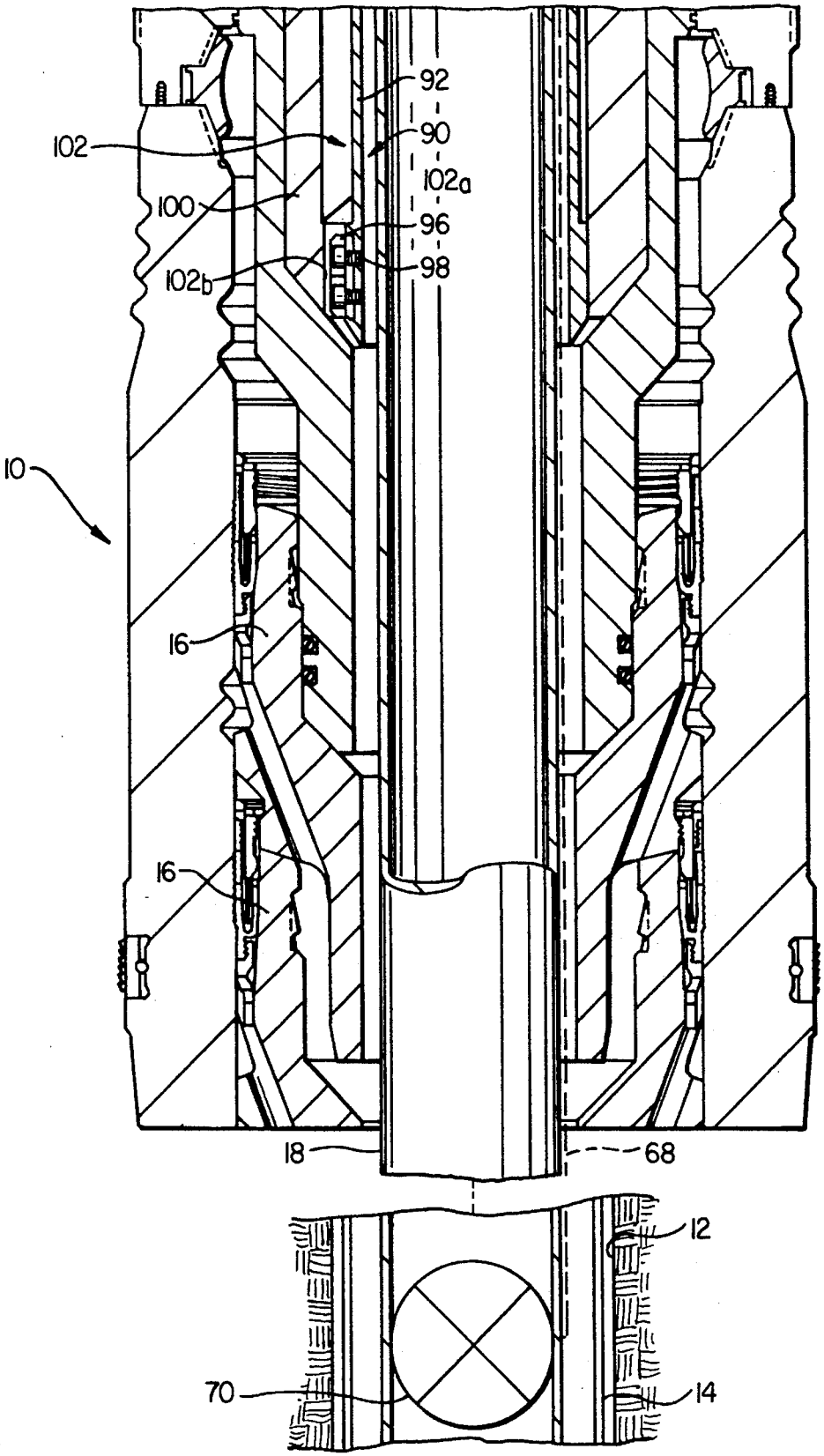
FIG. 1B is a vertical cross sectional view of a lower portion of the well production assembly of the present invention.

FIG. 1A shows the upper portion of the well production assembly 10 of the present invention. FIG. 1B shows the lower portion of the well production assembly 10 of the present invention. Referring first to FIG. 1B, wellbore 12 extends from the earth's surface downward to a fluid bearing formation (not shown) located below the earth's surface. At least one casing string 14 is conventionally suspended within a wellhead 15 housing by means of a casing hanger 16.

Production tubing string 18 extends concentrically within casing string 14 and conveys production fluids from the fluid bearing formation to the earth's surface. Production tubing string 18 is suspended within wellbore 12 by means of a tubing hanger 20 (shown in FIG. 1A). Production tubing string 18 is connected to the lower end of tubing hanger 20 by conventional means, such as threaded connection 22.

Tubing hanger 20 is concentrically landed within a wellhead member, or Christmas tree head 24, which is connected to the upper end of wellhead housing 15. Wellhead member 24 is annular in shape with bore 26 of stepped diameter extending therethrough.

Upward facing landing shoulder 28 is located between two sections of different diameter of bore 26. Downward facing landing shoulder 30 is formed on the stepped outer surface 32 of tubing hanger 20. When tubing hanger 20 is landed within wellhead member 24, landing shoulders 28, 30 suspend tubing hanger 20 within wellhead member 24.

Well production assembly 10 can be of either the vertical production type or the horizontal production type. The horizontal production type is has been selected for illustration purposes herein. Tubing hanger 20 has a tubing hanger production fluid passage 34 extending therethrough. Tubing hanger production fluid passage 34 has a longitudinal portion 34*a* extending longitudinally along longitudinal axis 36 of tubing hanger 20, and a lateral portion 34*b* extending laterally from longitudinal portion 34*a* to outer surface 32 of tubing hanger 20. Lockdown latch 38 and activation sleeve 40 vertically lock tubing hanger 20 in the desired vertical position within wellhead member 24.

A tree cap 42 is located above activation sleeve 40 and is maintained in place by lockdown latch 44 and activation sleeve 46. Tree cap 42 and seals 48 prevent production fluids from exiting through the upper end of the longitudinal portion 34*a* of production fluid passage 34 of tubing hanger 20.

A lateral production fluid passage 50 extends through wellhead member 24. Seals 52*a* and 52*b* isolate an annular region 54 between tubing hanger 20 and wellhead member 24 so that tubing hanger production fluid passage 34 is placed in communication with wellhead member production fluid passage 50 and with production line 56.

Bore 26 through wellhead member 24 has a concave frusto-spherical mating surface 58 extending between two sections of bore 26 of different diameters. Tubing hanger 20 has a convex frusto-spherical mating surface 60 which mates with mating surface 58 in bore 26 of wellhead member 24. Mating surfaces 58, 60 can also serve to suspend tubing hanger 20 within wellhead member 24.

A tubing hanger hydraulic fluid passage 62 extends through tubing hanger 20° Tubing hanger hydraulic fluid passage 62 has a longitudinal portion 62*a* which extends parallel to, but offset from, longitudinal axis 36 of tubing hanger 20. The lower end of tubing hanger hydraulic fluid passage 62 has a lower opening 64 located on the lower surface 66 of tubing hanger 20. A hydraulic fluid line 68 (shown schematically in FIGS. 1 and 1A) is connected to lower opening 64 and extends to downhole safety 29 valve 70.

Figure 2:
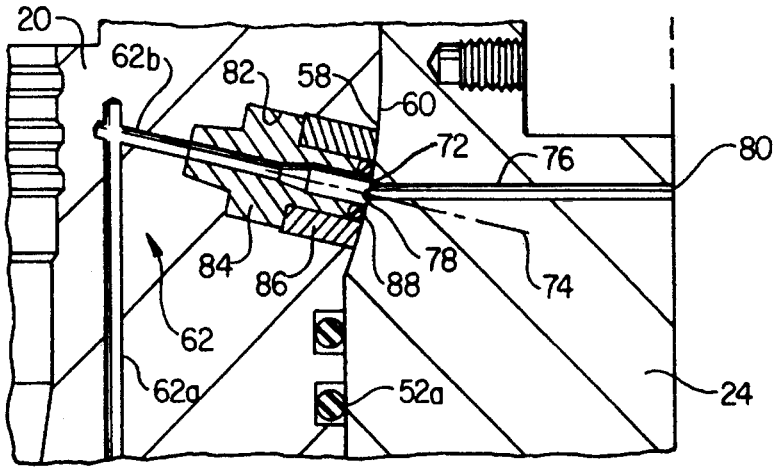
FIG. 2 is a detailed cross sectional view illustrating the sealing connection between the tubing hanger hydraulic fluid passage and the wellhead member hydraulic fluid passage of FIG. 1.

Referring now mainly to FIG. 2, at the upper end of tubing hanger hydraulic fluid passage 62 is a lateral portion 62*b* of tubing hanger hydraulic fluid passage 62 which extends from longitudinal portion 62*a* of tubing hanger hydraulic fluid passage 62 to mating surface 60 of tubing hanger 20. Lateral portion 62*b* terminates in a circular outboard opening 72 at mating surface 60. Lateral portion 62*b* extends radially and downwardly so that axis 74 of lateral portion 62*b* is perpendicular to mating surface 60 at the point where axis 74 intersects mating surface 60.

A wellhead member hydraulic fluid passage 76 extends laterally through a wall of wellhead member 24. Wellhead member hydraulic fluid passage 76 has an inboard opening 78 located at mating surface 58 of wellhead member 24.

Outer opening 80 of wellhead member hydraulic fluid passage 76 is located on the outer surface of wellhead member 24 and is connected to a hydraulic fluid source line (not illustrated).

Outboard opening 72 of tubing hanger hydraulic fluid passage 62 registers with inboard opening 78 of wellhead member hydraulic fluid passage 76. A rotational alignment means for ensuring that outboard opening 72 and inboard opening 78 are aligned is discussed in more detail herein.

A circular recess 82 is formed in one of the two mating surfaces 58, 60 around one of the two openings 72, 78. In this preferred embodiment, recess 82 is shown as being formed in mating surface 60, around outboard opening 72. Recess 82 has an axis concentric with axis 74 of lateral portion 62*b* and outboard opening 72.

An annular seal ring 84 is located within recess 82 and maintained in place by lock ring 86. Outboard portion 88 of seal 84 extends beyond the frusto-spherical mating surface 60 so that when tubing hanger 20 is landed within wellhead member 24, outboard portion 88 of seal 84 is compressed, thus resulting in a positive seal. The outboard portion 88 of seal 84 is circular in shape and forms outboard opening 72. The spherical shape of mating surface 58 on wellhead member 24 and the circular shape of outboard opening 72 formed by outboard portion 88 of seal 84 result in uniform loading of seal 84 and thus in an improved sealing action.

Referring again to FIGS. 1A and 1B, a rotational alignment means 90 ensures that outboard opening 72 and inboard opening 78 are aligned. A sleeve 92 is connected by fastening means 94 to lower surface 66 of tubing hanger 20. Connected to the lower portion of sleeve 92 is orientation key 96 which is connected to sleeve 92 by fastening means 98. A guide member 100 is fixedly connected to wellhead member 24. A keyway 102, comprising a helical portion 102*a* and a longitudinal portion 102*b*, is formed in guide member 100. The vertical portion 102*b* of keyway 102 is located at the lower end of helical portion 102*a* of keyway 102. As tubing hanger 20 is landed within wellhead member 24, key 96 enters helical portion 102*a* of keyway 102 and causes tubing hanger 20 to rotate toward the desired angular position. Once key 96 reaches the end of helical portion 102*a* of keyway 102, it enters vertical portion 102*b* of keyway 102 thus placing tubing hanger 20 in the proper vertical and rotational alignment with wellhead member 24. When tubing hanger 20 and wellhead member 24 are properly aligned, outboard opening 72 registers with inboard opening 78.

In operation, tubing hanger 20 is connected to the upper extremity of production tubing string 18. As tubing hanger 20 is lowered into wellhead member 24, production tubing string 18 is lowered through casing string 14 in wellbore 12. As tubing hanger 20 is lowered into wellhead member 24, key 96 engages helical portion 102*a* of keyway 102 and guides tubing hanger 20 as tubing hanger 20 is lowered further into wellhead member 24. Once key 96 reaches the end of helical portion 102*a* of keyway 102, key 96 enters into and engages longitudinal portion 102*b* of keyway 102 and guides tubing hanger 20 into its proper position within wellhead member 24.

In this position, outboard opening 72 registers with inboard opening 78, and tubing hanger 20 is landed within wellhead member 24. Landing shoulders 28, 30 and mating surfaces 58, 60 suspend tubing hanger 20 within wellhead member 24.

Hydraulic fluid is pumped through wellhead member hydraulic passage 76, through tubing hanger hydraulic fluid passage 62, down hydraulic line 68, and to hydraulically operated downhole safety valve 70. The hydraulic fluid pressure maintains safety valve 70 in the open position so that production fluids can flow up production tubing string 18, through tubing hanger production fluid passage 34, through wellhead production fluid passage 50, and to production line 56. In case of an emergency, the hydraulic pressure to downhole safety valve 70 is relieved, and safety valve 70, being biased toward its closed position, returns to its closed position, thus shutting off flow through production tubing string 18.

Figure 3:
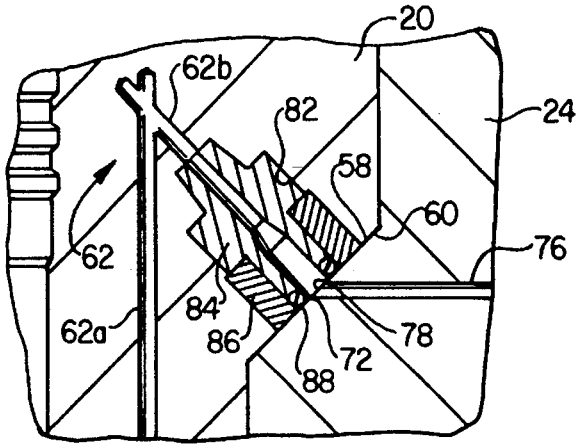
FIG. 3 is a detailed cross sectional view illustrating a second embodiment of the sealing connection shown in FIG. 2.

Referring now to FIG. 3, a second embodiment of the sealing connection between tubing hanger hydraulic fluid passage 62' and the wellhead member hydraulic fluid passage 76' is shown. In this second embodiment, mating surface 60' on tubing hanger 20', instead of being frusto-spherical in shape as shown in FIG. 2, is frusto-conical in shape as shown in FIG. 3. Likewise, mating surface 58' of wellhead member 24' is frusto-conical in shape instead of being frusto-spherical in shape as was the case in the embodiment of FIG. 2. Lateral portion 62*b'* of tubing hanger hydraulic fluid passage 62' extends radially and downwardly so that axis 74' of lateral portion 62*b'* is perpendicular to mating surface 60' at the point where axis 74' intersects mating surface 60'. Seal recess 82' seal ring 84' and lock ring 86' are identical to the corresponding components of the embodiment of FIG. 2.

Figure 4:
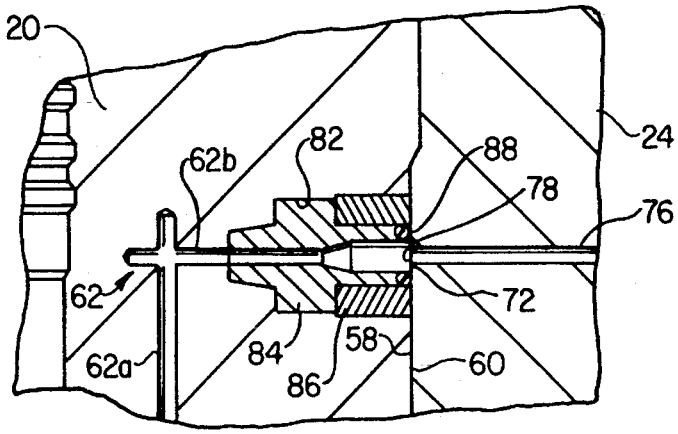
FIG. 4 is a detailed cross sectional view illustrating a third embodiment of the sealing connection shown in FIG. 2.

Referring now to FIG. 4, a third embodiment of the sealing connection between tubing hanger hydraulic fluid passage 62" and the wellhead member hydraulic fluid passage 7640 is shown. In this third embodiment, mating surface 60' on tubing hanger 20", instead of being frusto-spherical in shape as shown in FIG. 2, is cylindrical in shape as shown in FIG. 4. Likewise, mating surface 58" of wellhead member 24' is cylindrical in shape instead of being frusto-spherical in shape as was the case in the embodiment of FIG. 2. Lateral portion 62*b"* of tubing hanger hydraulic fluid passage 62" extends radially so that axis 74" of lateral portion 62*b"* is perpendicular to mating surface 60". Seal recess 82" seal ring 84" and lock ring 86" are identical to the corresponding components of the embodiment of FIG. 2. In this embodiment, however, mating surfaces 58", 60' would not be capable of aiding in suspending tubing hanger 20" within wellhead member 24".

Figure 5:
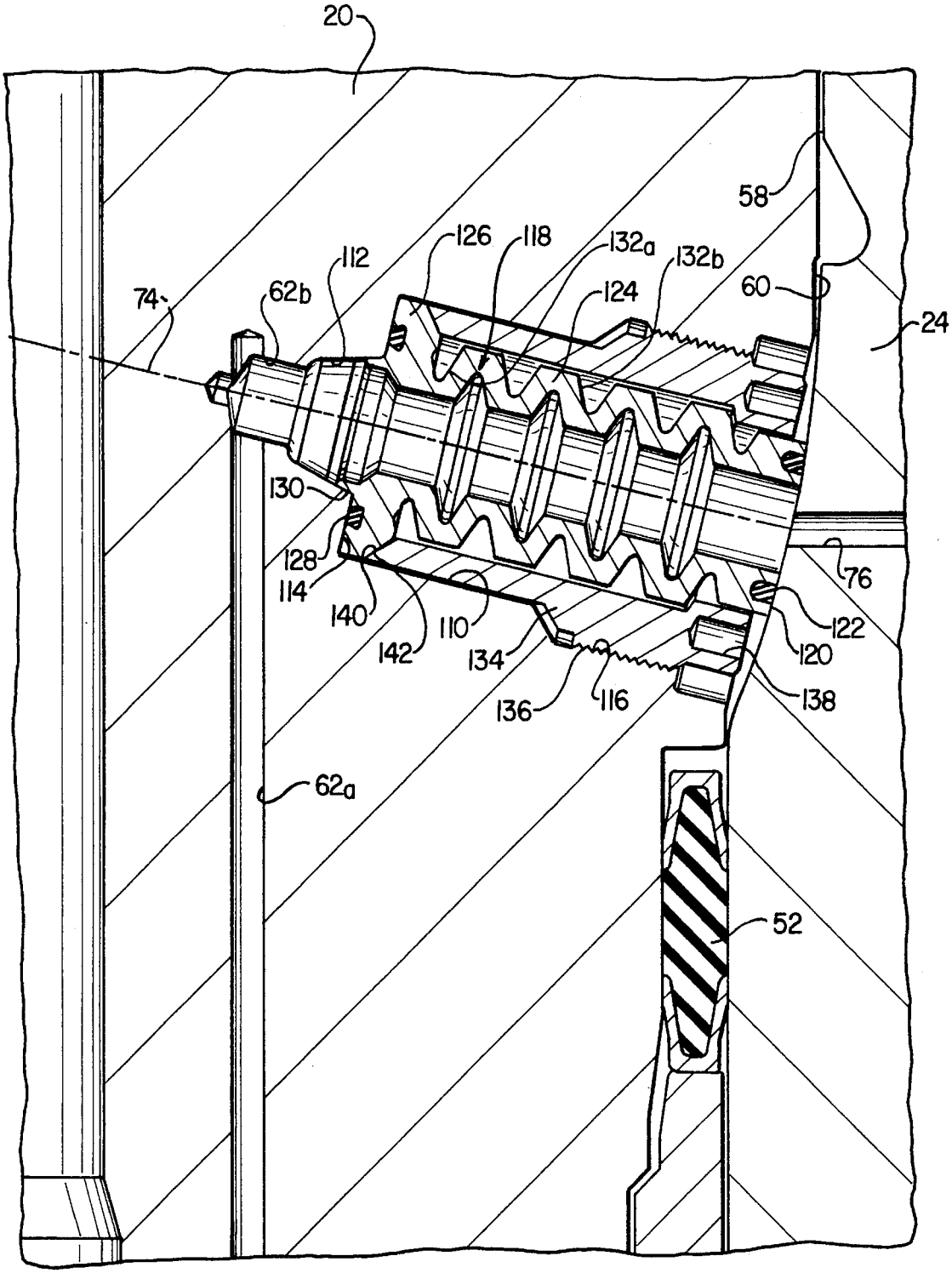
FIG. 5 is an enlarged cross-sectional view illustrating a fourth embodiment of the sealing connection shown in FIG. 2.

Referring to FIG. 5, a fourth embodiment is shown. In this embodiment, tubing hanger 20 and wellhead housing 24 are shown with spherical mating surfaces 60, 58, as in FIG. 2. The fourth embodiment could also use the conical or cylindrical mating surfaces as shown in FIGS. 3 and 4. Seal 52 is shown to be a rectangular elastomeric seal, rather than the O-ring seals 52A of FIG. 2. Seal 52 could also be a metal type seal as well. In this embodiment, a new sealing means for sealing the wellhead hydraulic fluid passage 76 to the tubing hanger hydraulic fluid passage 62 is shown.

The sealing means includes a seal recess which has a cylindrical counterbore 110 that opens onto tubing hanger mating surface 60. Counterbore 110 leads inward to a tapered surface section 112. Tapered section 112 is generally conical, with its largest diameter substantially smaller than the diameter of counterbore 110. This results in an outward facing shoulder 114 at the junction between counterbore 110 and tapered surface 112. Shoulder 114 is perpendicular to the seal recess axis 74. A set of threads 116 is formed in an outer portion of counterbore 110. The threads 116 are in a larger diameter portion than the inner portion which joins shoulder 114.

A metal tubular seal member 118 is located within counterbore 110 and tapered section 112. Seal member 118 has a face 120 located on its outer end. Face 120 is a metal seal and contains an inlay of soft metal. Also, in the embodiment shown, an elastomeric seal 122 is located in face 120 for serving as a back-up.

Seal member 118 has a tubular sidewall 124 that is coaxial with axis 74. A flange 176 is located on the inner end sidewall 124. Flange 126 protrudes radially outward, having an outer diameter that is substantially the same as the inner diameter of counterbore 110 at its junction with shoulder 114. Flange 126 has an inward facing side that is flat and abuts shoulder 114. A secondary elastomeric seal 128 is located on the inward facing side of flange 126 in sealing engagement with shoulder 114. A tapered seal section 130 is integrally formed with seal member 118 and protrudes inward from flange 126. Tapered seal section 130 has a tapered exterior that sealingly engages the tapered surface 112.

Seal member 118 has an initial axial length that is greater than the axial length of counterbore 110, causing it to initially protrude slightly outward from tubing hanger mating surface 60. As tubing hanger 20 lands, face 120 will contact mating surface 58, forcing sidewall 124 to deflect, decreasing in length. The means to cause this deflection preferably includes interior and exterior triangular grooves 132*a*, 132*b*, which provide a corrugated configuration to sidewall 124. The width or thickness of sidewall 124 is uniform. The amount of contraction does not exceed the yield strength of the sidewall 124, thus is not a permanent deformation. In one embodiment, seal member 118 is constructed of a nickel alloy having a yield strength of approximately 120,000 thousand per square inch and a wall thickness of sidewall 124 is 0.162 inch. The inward deflection of face 120 is approximately 0.050 inch. The high yield strength and thick walls of sidewall 124 provide a substantial stiffness to sidewall 124, requiring a high force to cause it to deflect. This results in a high preload force, urging face 120 against mating surface 58.

A retainer 134 surrounds seal member 118 to hold seal member 118 within counterbore 110. Retainer 134 is a cylindrical member having external threads 136 which engage counterbore threads 116. Retainer 134 has a plurality of holes 138 on its outward facing side for engagement by wrench (not shown) for securing it within counterbore 110. Retainer 134 has a tapered inner end 140 which engages a tapered edge 142 on the outer side of seal member flange 126.

In the operation of the embodiment of FIG. 5, tubing hanger 20 will orient and land as previously described. The protruding face 120 of seal member 18 will engage mating surface 58 after it is oriented and approximately one-fourth inch from reaching its final landed position. Some sliding contact will occur between face 120 and mating surface 58. Sidewall 124 will contract, preloading face 120 against wellhead mating surface 58. When deflecting inward, sidewall 124 will move relative to retainer 134 and relative to tapered seal section 130. In the final position shown in FIG. 5, axis 74 will intersect the axis of wellhead member hydraulic fluid passage 76. Seal member face 120 will surround wellhead member hydraulic passage 76.

Hydraulic fluid pressure within passages 62 and 76 will be sealed by face 120 and also by tapered seal section 130. Increased hydraulic pressure results in a greater sealing force of tapered seal section 130 against tapered surface 112. If any hydraulic pressure is encountered on the exterior of seal member 118 greater than the interior, the hydraulic pressure would act on the exterior of sidewall 124, pushing flange 126 more tightly against shoulder 114.

While the invention has been particularly shown and described with reference to several embodiments, it will be understood by those skilled in the art that various changes in form and detail may be made therein without departing from the scope of the invention.

What is claimed:

1. A well production assembly comprising in combination:

a wellbore extending from the earth's surface downward to a fluid bearing formation located below the earth's surface;

a tubular wellhead housing located at an upper end of a string of casing which extends into the wellbore;

a production tree mounted to an upper end of the wellhead housing, having a bore and a production fluid outlet for delivering production fluids from the formation to the exterior of the tree, the tree having an inner mating surface and a fluid passage having a lateral portion extending through the tree with an inboard port at the inner mating surface;

an insert member landed concentrically within the bore of the tree, the insert member having an outer mating surface which mates with the inner mating surface of the tree;

a fluid passage extending through the insert member and having an outboard seal recess located on the outer mating surface of the insert member, registering with the inboard port of the fluid passage of the tree; and a seal carried within the seal recess, having a face on an outer end which seals against the inner mating surface of the tree and surrounds the inboard port.

2. The well production assembly according to claim 1 wherein the outer mating surface of the insert member comprises a convex, frusto-spherical surface, and the inner mating surface of the tree comprises a concave, frusto-spherical surface.

3. The well production assembly according to claim 1 wherein the outer mating surface of the insert member comprises a convex, frusto-conical surface, and the inner mating surface of the tree comprises a concave, frusto-conical surface.

4. The well production assembly according to claim 1 wherein the outer mating surface of the insert member comprises a cylindrical surface, and the inner mating surface of the tree comprises a cylindrical surface.

5. The well production assembly according to claim 1 wherein the insert member is a tubing hanger located at an upper end of a string of production tubing which extends into the casing for conveying production fluids from the formation to the outlet of the tree.

6. The well production assembly according to claim 1 wherein:

the fluid outlet of the tree extends laterally from the bore of the tree; and the insert member is a tubing hanger located at an upper end of a string of production tubing which extends into the casing, the tubing hanger having a laterally extending production fluid passage for conveying production fluids from the formation to the fluid outlet of the tree.

7. The well production assembly according to claim 1 wherein the seal recess of the insert member comprises an inner tapered seal surface joining an outer counterbore section, and wherein the seal comprises:

a metal tubular member having the face on an outer end, a tapered seal section on an inner end, and a sidewall;

a retainer secured to the counterbore, encircling and engaging a portion of the tubular member and forcing the tapered seal section into sealing engagement with the tapered seal surface; and wherein the sidewall is axially deflectable along the seal axis and dimensioned so that the face initially protrudes a selected distance past the outer mating surface of the insert member prior to installing the insert member within the tree, and once in engagement with the inner mating surface of the tree, the face moves axially inward relative to the retainer and the tapered seal section.

8. A well production assembly comprising in combination:

a wellbore extending from the earth's surface downward to a fluid bearing formation located below the earth's surface;

at least one casing string suspended within the wellbore;

a production tubing string extending within the casing string, the production tubing string conveying production fluids from the fluid bearing formation to the earth's surface;

an annular wellhead member located at an upper end of the wellbore, having an inner mating surface and an auxiliary fluid passage which has a portion extending laterally through the wellhead member, terminating at an inboard port at the inner mating surface;

a tubing hanger connected to the upper extremity of the production tubing string and landed concentrically within the wellhead member for suspending the production tubing string within the wellbore, the tubing hanger having an outer mating surface which mates with the inner mating surface of the wellhead member;

a production fluid passage extending through the tubing hanger for placing the production tubing string in communication with a production line;

a tubing hanger auxiliary fluid passage extending through the tubing hanger and having an outboard seal recess, the outboard seal recess being located on the outer mating surface of the tubing hanger and registering with the inboard port of the wellhead member auxiliary fluid passage, wherein auxiliary fluid is transmitted between the exterior of the wellhead member and the tubing hanger auxiliary fluid passage;

rotational alignment means for aligning the seal recess of the tubing hanger auxiliary fluid passage and the inboard port of the wellhead member auxiliary fluid passage; and an annular seal carried within the seal recess and having a seal axis concentric with an axis of the seal recess, the seal having a face sealing against the inner mating surface of wellhead member around the inboard port, providing a sealing connection between the tubing hanger auxiliary fluid passage and the wellhead member auxiliary fluid passage.

9. The well production assembly according to claim 8 wherein the outer mating surface of the tubing hanger comprises a convex, frusto-spherical surface, and the inner mating surface of the wellhead member comprises a concave, frusto-spherical surface.

10. The well production assembly according to claim 8 wherein the outer mating surface of the tubing hanger comprises a convex, frusto-conical surface, and the inner mating surface of the wellhead member comprises a concave, frusto-conical surface.

11. The well production assembly according to claim 8 wherein the outer mating surface of the tubing hanger comprises a cylindrical surface, and the inner mating surface of the wellhead member comprises a cylindrical surface.

12. The well production assembly according to claim 8 wherein the rotational alignment means comprises a key fixedly connected to the tubing hanger and an orientation keyway in the wellhead member wherein, as the tubing hanger is landed into the wellhead member, the key and orientation keyway guide the tubing hanger into proper alignment with the wellhead member.

13. The well production assembly according to claim 8 wherein the outboard seal surface of the tubing hanger comprises an inner tapered seal surface joining an Outer counterbore section, and wherein the seal comprises:

a metal tubular member having the face of the seal on an outer end, a tapered seal section on an inner end, and a sidewall;

a retainer secured to the counterbore, encircling and engaging a portion of the tubular member and forcing the tapered seal section into sealing engagement with the tapered seal surface; and wherein the sidewall is axially deflectable along the seal axis and dimensioned so that the face initially protrudes a selected distance past the outer mating surface of the tubing hanger prior to installing the tubing hanger within the wellhead member, and once in engagement with the inner mating surface of the wellhead member, the face moves axially inward relative to the retainer and the tapered seal section.

14. A well production assembly, comprising in combination:

an annular wellhead member located at an upper end of the wellbore and having an inner mating surface;

an insert member landed concentrically within the wellhead member and having an outer mating surface which engages the inner mating surface;

a fluid passage extending laterally through the wellhead member and having an inboard port at the inner mating surface of the wellhead member;

a fluid passage extending through the insert member, having a lateral portion terminating in an outboard seal recess at the outer mating surface which has a seal axis and which registers with the inboard port;

the seal recess having an inner tapered seal surface joining an outer counterbore section;

a metal tubular seal member having a face on an outer end, a tapered seal section on an inner end, and a sidewall;

a retainer secured to the counterbore, encircling and engaging a portion of the seal member and forcing the tapered seal section into sealing engagement with the tapered seal surface of the recess; and wherein the sidewall is axially deflectable along the seal axis and dimensioned so that the face initially protrudes a selected distance past the seal recess of the insert member prior to installing the insert member within the wellhead member for engaging the mating surface of the wellhead member during installation, causing the face to move axially inward relative to the retainer and the tapered seal section.

15. The well production assembly according to claim 14, wherein the sidewall of the seal member contains circumferentially extending grooves for allowing axial deflection of the sidewall.

16. The well production assembly according to claim 14, wherein the sidewall of the seal member has a corrugated configuration for allowing axial deflection of the sidewall.

17. The well production assembly according to claim 14, wherein:

the tapered surface and the counterbore of the seal recess are separated by an outward facing shoulder;

the seal member has a flange formed at an inner end of the sidewall which abuts the outward facing shoulder; and the retainer has an inner end which abuts the flange to retain the flange in contact with the shoulder.

18. The well production assembly according to claim 14, wherein:

the tapered surface and the counterbore of the seal recess are separated by an outward facing shoulder;

the seal member has a flange formed at an inner end of the sidewall which has an inward facing side which abuts the outward facing shoulder;

the flange has seal means on the inward facing side of the flange for sealing against the outward facing shoulder; and the retainer is secured by threads to the counterbore and has an inner end which abuts the flange to retain the flange in contact with the shoulder.

19. The well production assembly according to claim 14, wherein an elastomeric seal is located on the face of the seal member.

* * * * *

UNITED STATES PATENT AND TRADEMARK OFFICE

CERTIFICATE OF CORRECTION

PATENT NO. : 5,555,935
DATED : September 17, 1996
INVENTOR(S) : Norman Brammer, et al.

It is certified that error appears in the above-indentified patent and that said Letters Patent is hereby corrected as shown below:

Column 4, Line 44, "20°" should be --20--;

Column 6, Line 30, "7640" should be --76"--.

Signed and Sealed this

Twenty-fifth Day of February, 1997

*Attest:*

*Attesting Officer*

BRUCE LEHMAN

*Commissioner of Patents and Trademarks*